US008851869B2

(12) United States Patent
Oono et al.

(10) Patent No.: US 8,851,869 B2
(45) Date of Patent: Oct. 7, 2014

(54) INTERNAL GEAR PUMP

(71) Applicant: JTEKT Corporation, Osaka (JP)

(72) Inventors: Yoshihiro Oono, Katsuragi (JP); Motoyasu Yamamori, Nagoya (JP); Daichi Kanda, Kariya (JP); Kenichi Takagi, Okazaki (JP)

(73) Assignees: JTEKT Corporation, Osaka-shi (JP); Toyooki Kogyo Co., Ltd., Okazaki-shi (JP)

( * ) Notice: Subject to any disclaimer, the term of this patent is extended or adjusted under 35 U.S.C. 154(b) by 133 days.

(21) Appl. No.: 13/705,596

(22) Filed: Dec. 5, 2012

(65) Prior Publication Data

US 2013/0149180 A1 Jun. 13, 2013

(30) Foreign Application Priority Data

Dec. 7, 2011 (JP) ..... 2011-267741

(51) Int. Cl.

| | |
|---|---|
| ***F01C 1/02*** | (2006.01) |
| ***F03C 2/08*** | (2006.01) |
| ***F04C 2/10*** | (2006.01) |
| ***F04C 2/08*** | (2006.01) |

(52) U.S. Cl.

CPC ..... *F04C 2/103* (2013.01); *F04C 2250/20* (2013.01); *F04C 2/102* (2013.01); *F04C 2/084* (2013.01)

USPC ..... 418/61.3

(58) Field of Classification Search

CPC ..... F04C 2/102; F04C 2/103; F04C 2/084; F04C 2250/20

USPC ..... 418/61.1, 61.3

See application file for complete search history.

(56) References Cited

U.S. PATENT DOCUMENTS

| | | | | |
|---|---|---|---|---|
| 3,424,095 | A * | 1/1969 | Hansen | 418/61.3 |
| 5,056,994 | A * | 10/1991 | Eisenmann et al. | 418/61.3 |
| 7,407,373 | B2 * | 8/2008 | Ogata et al. | 418/171 |
| 7,488,163 | B2 * | 2/2009 | Enzaka et al. | 418/190 |
| 7,641,457 | B2 * | 1/2010 | Asai et al. | 418/171 |

FOREIGN PATENT DOCUMENTS

| | | |
|---|---|---|
| JP | 2003-322088 | 11/2003 |
| JP | 2005-36735 | 2/2005 |

* cited by examiner

*Primary Examiner* — Hoang Nguyen

(74) *Attorney, Agent, or Firm* — Oblon, Spivak, McClelland, Maier & Neustadt, L.L.P.

(57) ABSTRACT

In an internal gear pump that includes an inner gear having outer teeth and an outer gear having inner teeth, either the inner or outer teeth have a shape based on a tooth shape that is respectively formed by a generating curve of the outer or inner teeth. The inner teeth are arc-shaped, the outer teeth are curved-shaped, and both end sections of the curved shape are arc-shaped. If a radius of the arc shape of the inner teeth is set as ro, a radius of the arc shape of each of the corner sections is set as ri, a diameter of a pitch circle of the inner teeth is set as dp, and the number of the inner teeth is set as z, the inner gear and the outer gear each has a shape that satisfies a relationship established by following equations: $1.6>ro/(dp/z)>1.0$; and $ro/(dp/z)>ri/(dp/z)\geq 0.13$. Each of the inner teeth is provided so that an intersecting point between one of arcs that follow the first arc shapes of the adjacent inner teeth and the pitch circle of the inner teeth and in proximity to the other arc is located outside of the other arc.

1 Claim, 7 Drawing Sheets

FIG. 4A
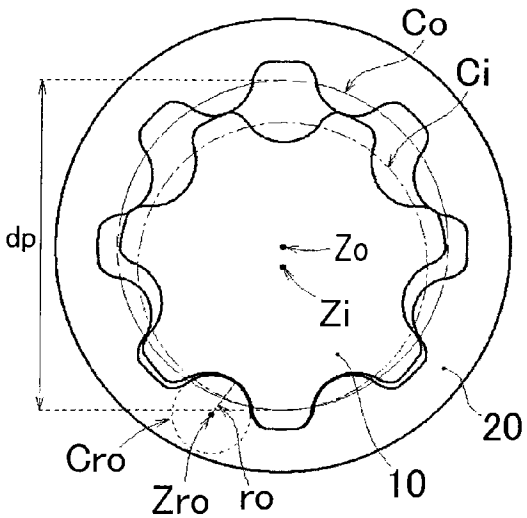
FIG. 4B
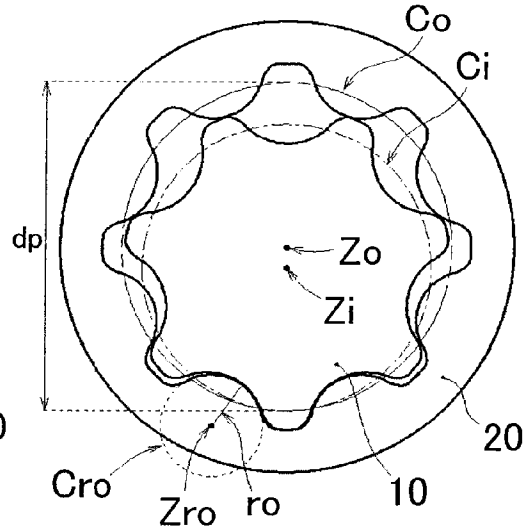
FIG. 4C
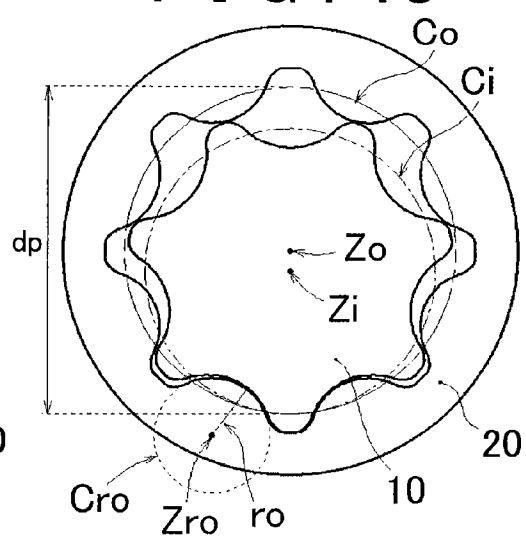
FIG. 4D
60
| | AMOUNT OF ECCENTRICITY | NUMBER OF TOOTH | OUTER PITCH DIAMETER | INNER TOOTH ARC RADIUS | OUTER TOOTH CORNER SECTION RADIUS | RATIO | RATIO |
|---|---|---|---|---|---|---|---|
| | | z | dp | ro | ri | ro/(dp/z) | ri/(dp/z) |
| | mm | – | mm | mm | mm | – | – |
| (A) | 1.55 | 8 | 24.8 | 3.0 | 0.30 | 1.0 | 0.10 |
| (B) | 1.55 | 8 | 24.8 | 4.0 | 0.42 | 1.3 | 0.13 |
| (C) | 1.52 | 8 | 24.3 | 4.7 | 0.38 | 1.6 | 0.12 |

INTERNAL GEAR PUMP

INCORPORATION BY REFERENCE

The disclosure of Japanese Patent Application No. 2011-267741 filed on Dec. 7, 2011 including the specification, drawings and abstract is incorporated herein by reference in its entirety.

BACKGROUND OF THE INVENTION

1. Field of the Invention

The present invention relates to an internal gear pump that performs suction and discharge of fluid by a structure in which an inner tooth of an outer gear meshes with an outer tooth of an inner gear.

2. Description of Related Art

Internal gear pumps have been used such as for automotive oil pumps, and include an inner gear having n outer teeth, an outer gear having n+1 inner teeth that mesh with the outer teeth, and a housing that houses the inner gear and the outer gear therein. The housing is provided with a suction mouth for drawing fluid and a discharge mouth for discharging the fluid. Various shapes have been suggested for the inner teeth of the outer gear and the outer teeth of the inner gear for purposes such as reduction of resistance.

For example, related art disclosed in Japanese Patent Application Publication No. 2003-322088 (JP 2003-322088 A) suggests that top lands and bottom lands of outer teeth are defined by cycloid curves that are generated by a circumscribed-rolling cycle of an inner gear that rotates while contacting the outer periphery of an inner gear base circle, which is a base circle of the outer teeth with a rotational axis of the inner gear as its center, and an inscribed-rolling circle of the inner gear that rotates while contacting the inner periphery of the inner gear base circle. Similarly, top lands and bottom lands of inner teeth are defined by cycloid curves that are generated by a circumscribed-rolling cycle of an outer gear that rotates while contacting the outer periphery of an outer gear base circle, which is a base circle of the inner teeth with an rotational axis of the outer gear as its center, and an inscribed-rolling circle of the outer gear that rotates while contacting the internal periphery of the outer gear base circle. As a result, sliding resistance and rattling are reduced. In addition, related art disclosed in Japanese Patent Application Publication No. 2005-36735 (JP 2005-36735 A) suggests that bottom lands of outer teeth of an inner gear are defined by a hypocycloid curve and that meshing sections between top lands and the bottom lands of the outer teeth of the inner gear are defined by an involute curve. This gives freedom in setting of a displacement amount of a rotor to increase a discharge amount.

In recent years, weight reduction and improved efficiency have been requested for each component of an automobile for the purpose of improved fuel efficiency of automobiles, etc. The size reduction sounds appropriate as an approach to the weight reduction. However, if only the size is simply reduced, a discharging capability of a pump is also reduced. The related art disclosed in JP 2003-322088 A uses the cycloid curve to determine shapes of the inner teeth and the outer teeth. However, when the cycloid curve is used, height of the teeth cannot be adjusted when the number of teeth is fixed. If the height of the teeth cannot be freely adjusted, it is impossible to reduce the size of an internal gear pump while maintaining the discharging capability. It is because the height of the teeth influences the discharging capability of the internal gear pump. The resistance reduction can be suggested as an approach to the improved efficiency. It has been known that efficiency of the internal gear pump is reduced by slippage that occurs between the outer tooth of the inner gear and the inner tooth of the outer gear. However, specific means for the improved efficiency is not suggested in the related art disclosed in JP 2005-36735 A.

SUMMARY OF THE INVENTION

The present invention provides an internal gear pump with which both size reduction and improved efficiency can be possible.

One aspect of the present invention relates to the internal gear pump. This internal gear pump includes an inner gear that has plural outer teeth on an outer peripheral surface of the inner gear, and an outer gear that is formed with a housing space that is capable of housing the inner gear and that includes plural inner teeth that mesh with the outer teeth on an inner peripheral surface that forms the housing space. One of the inner teeth and the outer teeth have a shape based on a tooth shape that is respectively formed from a generating curve of the other of the inner teeth and the outer teeth. A section of each of the inner teeth that protrudes in a direction toward the inner gear has a first arc shape. A section of each of the outer teeth that protrudes in a direction toward the outer gear has a curved shape. Each of both end sections of the curved shape have a second arc shape. If a radius of the first arc shape is set as ro, a radius of the second arc shape is set as ri, a diameter of a pitch circle of the inner teeth is set as dp, and the number of the inner teeth is set as z, the inner gear and outer gear each has a shape that satisfies a relationship established by following equations: $1.6>ro/(dp/z)>1.0$; and $ro/(dp/z)>ri(dp/z)\geq 0.13$. Each of the inner teeth is provided so that an intersecting point between one of arcs that follow the first arc shapes of the adjacent inner teeth and the pitch circle of the inner teeth and that is in proximity to the other arc is located outside of the other arc.

According to this aspect, slippage that occurs between the outer teeth of the inner gear and the inner teeth of the outer gear can appropriately be reduced. In addition, the inner teeth and the outer teeth are formed without using a cycloid curve, and thus height of the teeth is freely adjustable. Therefore, it is possible to achieve size reduction while maintaining a discharging capability of the pump. Furthermore, each of the inner teeth can be arranged in an appropriate position that prevents interference with the adjacent inner teeth.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 4A to FIG. 4C show three exemplary shapes of the outer gear and the inner gear in which a radius of an arc, which determines shapes of the inner teeth of the outer gear, is changed;

FIG. 4D is a table for explaining dimensions of each section in FIG. 4A to FIG. 4C;

DETAILED DESCRIPTION OF EMBODIMENTS

A description will hereinafter be made on an embodiment of the present invention with accompanied drawings.

[Overall Structure of an Internal Gear Pump 1 (FIG. 1 to FIG. 3)]

Figure 1:
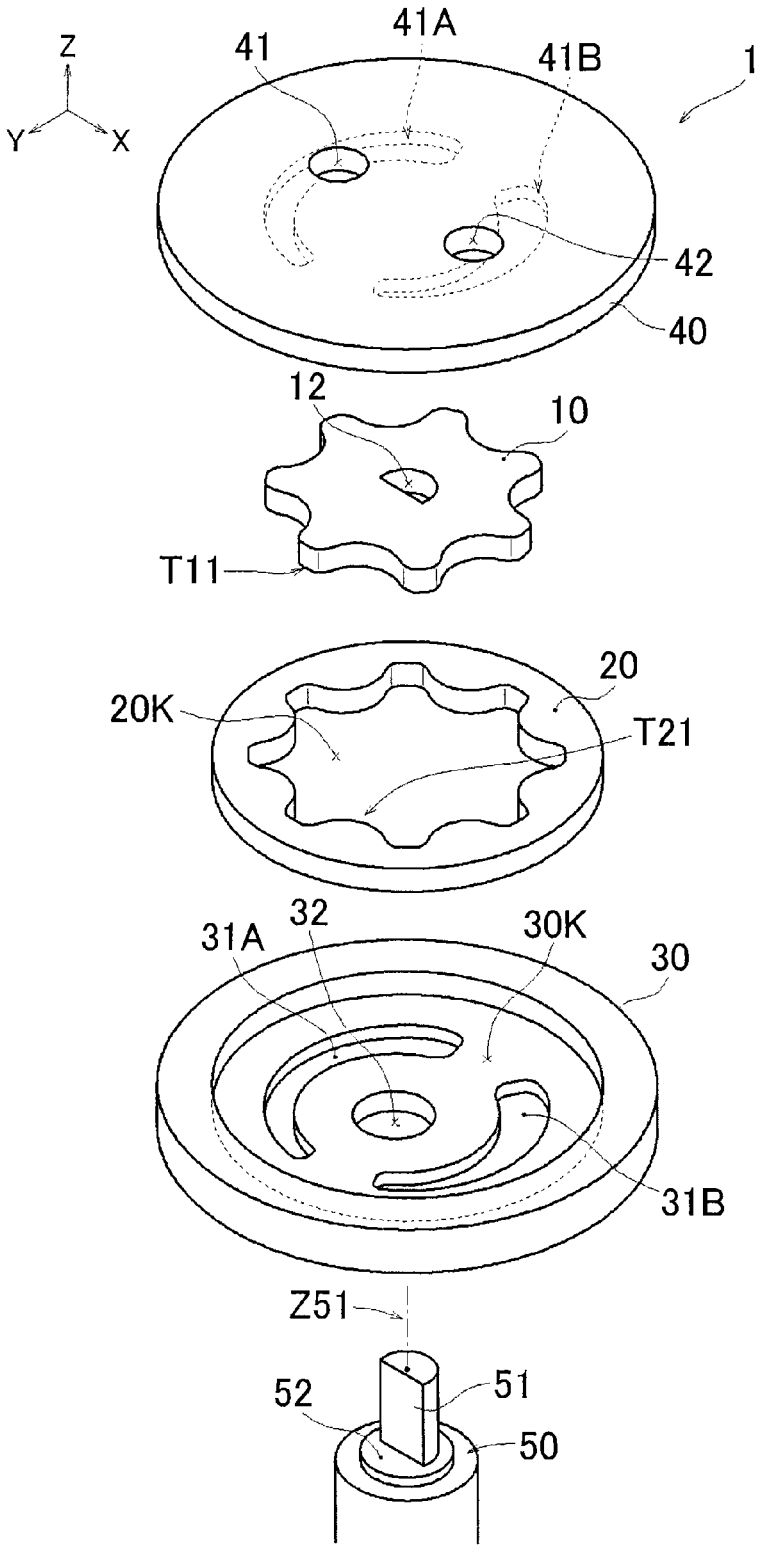
FIG. 1 is a perspective view for explaining an embodiment of a structure of an internal gear pump.
Figure 2A:
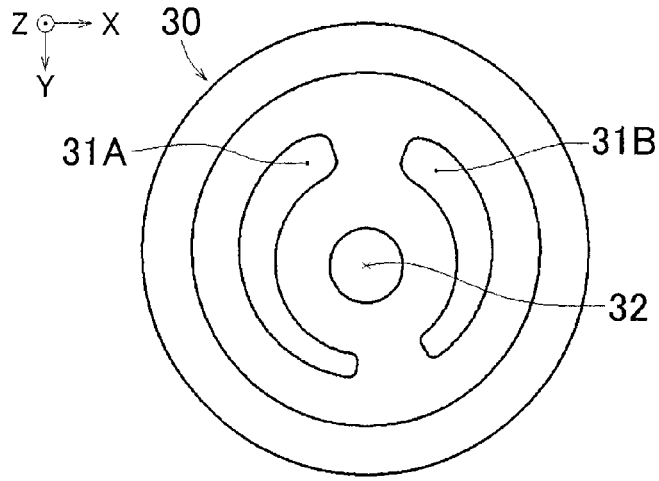
FIG. 2A is a view of a housing in FIG. 1 that is seen from a pump plate side.
Figure 2B:
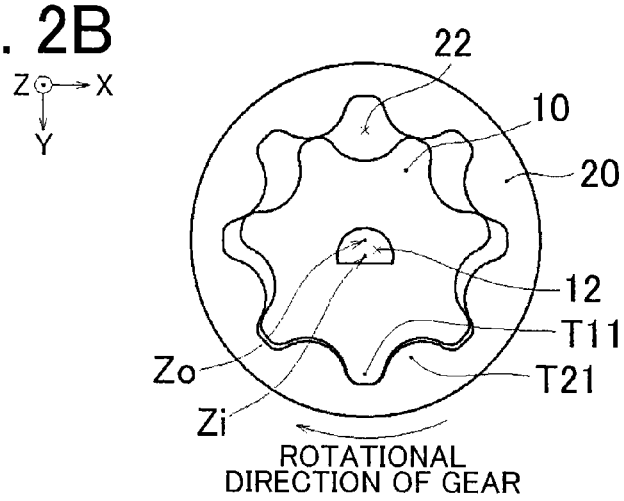
FIG. 2B is a view of an inner gear and an outer gear in FIG. 1 that are seen from the pump plate side.
Figure 2C:
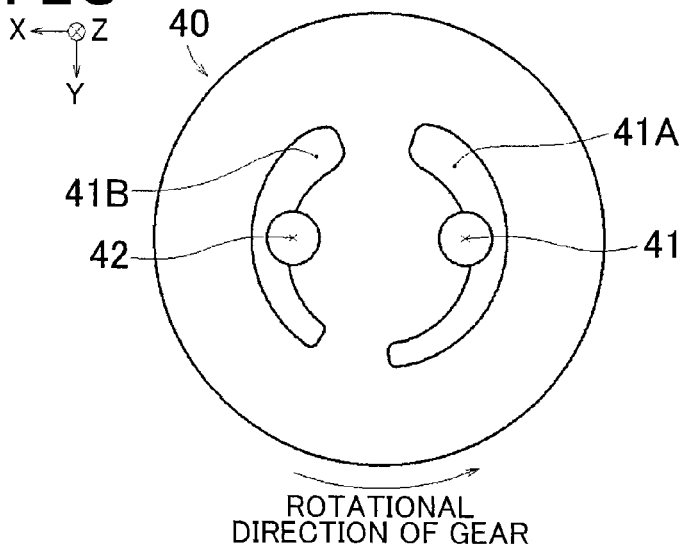
FIG. 2C is a view of a pump plate in FIG. 1 that is seen from a housing side.

A description is first made on a structure of an internal gear pump 1 with reference to a perspective view in FIG. 1. The internal gear pump 1 is constructed from an inner gear 10, an outer gear 20, a housing 30, a pump plate 40, and a drive shaft member 50. The inner gear 10 is housed in a housing space 20K of the outer gear 20. The inner gear 10 and the outer gear 20 are housed in a gear housing space 30K that is formed by the pump plate 40, which functions as a rid for the housing 30, and the housing 30. In the drive shaft member 50, a shaft 51, which is rotatable about an axis Z51, is inserted through a through hole 32 formed in the housing 30 and a shaft hole 12 formed in the inner gear 10 so as to drive the inner gear 10 for rotation. This axis Z51 is a rotational axis Zi of the inner gear 10, which will be described later. The reference numeral 52 denotes a sealing member. FIG. 2C is a view of the pump plate 40 in FIG. 1 that is seen from the housing 30 side. FIG. 2B is a view of the outer gear 20 and the inner gear 10 in FIG. 1 that are seen from the pump plate 40 side. FIG. 2A is a view of the housing 30 in FIG. 1 that is seen from the pump plate 40 side.

Figure 3A:
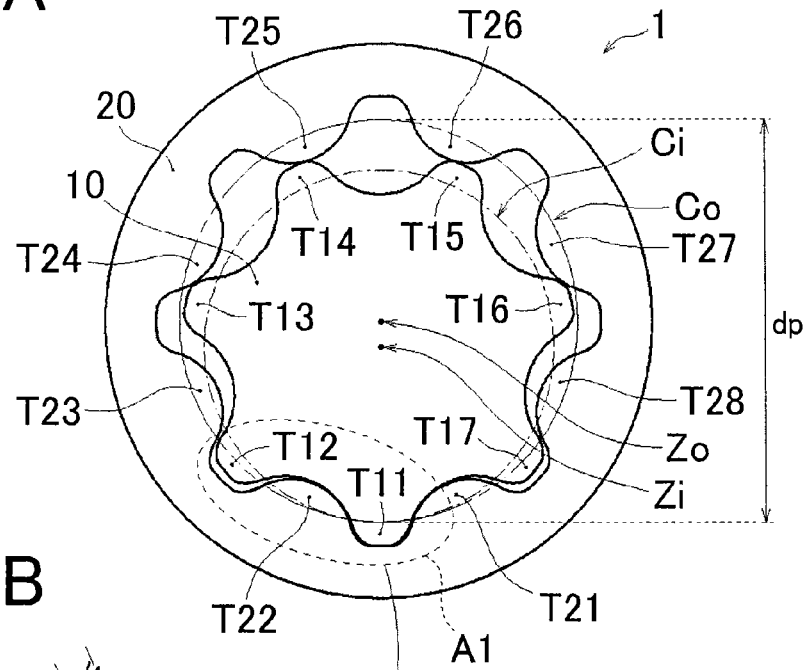
FIG. 3A is a view for explaining a state in which inner teeth of the outer gear mesh with outer teeth of the inner gear.

As shown in FIG. 3A, the inner gear 10 is provided on an outer peripheral surface thereof with plural outer teeth T11 to T17 that mesh with inner teeth T21 to T28 of the outer gear 20, and this embodiment shows an example in which the number of the outer teeth is seven. The outer gear 20 has the housing space 20K that can house the inner gear 10, and an inner peripheral surface of the outer gear 20, which forms the housing space 20K, has the plural inner teeth T21 to T28 that mesh with the outer teeth T11 to T17 of the inner gear 10. This embodiment shows an example in which the number of the inner teeth is eight. In FIG. 3A, an outer pitch circle Co is a pitch circle of the inner teeth T21 to T28 of the outer gear 20, and an inner pitch circle Ci is a pitch circle of the outer teeth T11 to T17 of the inner gear 10. In addition, as shown in FIG. 2B and FIG. 3A, a rotational axis Zo of the outer gear 20 and the rotational axis Zi of the inner gear 10 are dislocated from each other. Accordingly, when the inner gear 10 rotates about the rotational axis Zi, the outer gear 20 rotates about the rotational axis Zo, and a volume of a closed space 22 that is formed between the outer teeth T11 to T17 of the inner gear 10 and the outer teeth T21 to T28 of the outer gear 20 first gradually increases, and then gradually decreases. A suction mouth 41 of fluid is provided in a side where the volume gradually increases, and a discharge mouth 42 of the fluid is provided in a side where the volume gradually decreases (see FIG. 2C). In this embodiment, an example in which the suction mouth 41 and the discharge mouth 42 are provided in the pump plate 40 is described.

As shown in FIG. 1, FIG. 2A, and FIG. 2C, in the gear housing space 30K, which is a space for housing the outer gear 20 and the inner gear 10 and is also a space formed by the pump plate 40 and the housing 30, a surface of the pump plate 40 that faces the housing 30 is formed with a suction port 41A that continuously extends from the suction mouth 41 in a circumferential direction and is a generally crescent-shaped concave section. Meanwhile, a surface of the housing 30 that faces the suction port 41A of the pump plate 40 is formed with a suction port 31A that is in the same shape as the suction port 41A and thus is the generally crescent-shaped concave section. Similarly, in the gear housing space 30K, the surface of the pump plate 40 that faces the housing 30 is formed with a discharge port 41B that continuously extends from the discharge mouth 42 in the circumferential direction and is the generally crescent-shaped concave section. The surface of the housing 30 that faces the discharge port 41B of the pump plate 40 is formed with a discharge port 31B that is in the same shape as the discharge port 41B and thus is the generally crescent-shaped concave section.

[An Arc Shape of the Inner Teeth of the Outer Gear 20, an Arc Shape of the Corner Section of the Inner Gear 10, and a Meshing Area Between the Outer Gear 20 and the Outer Gear 10 (FIG. 3)]

Figure 3B:
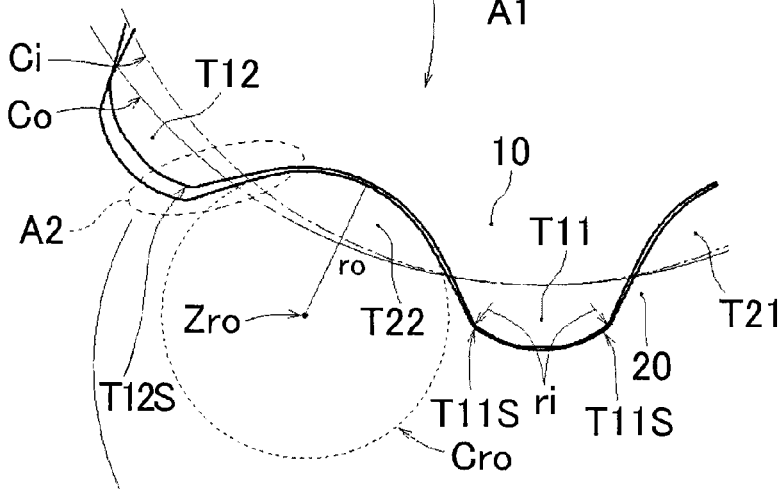
FIG. 3B is an enlarged view of peripheries of the inner teeth and the outer teeth.
Figure 3C:
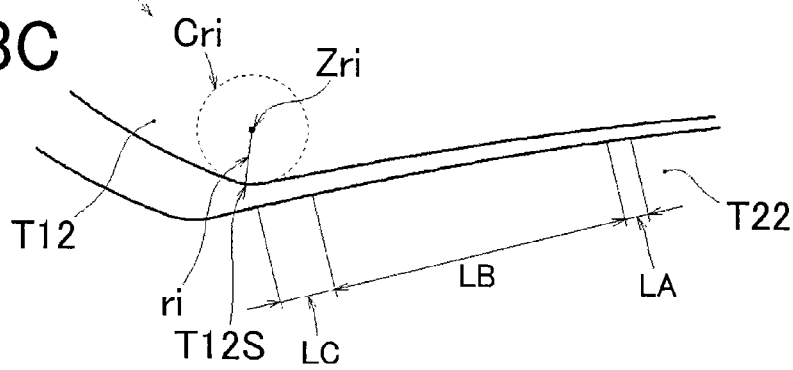
FIG. 3C is an enlarged view of a periphery of a corner section of the outer tooth.

FIG. 3A to FIG. 3C show a meshing state between the inner gear 10 and the outer gear 20. FIG. 3B is an enlarged view of an area A1 in FIG. 3A, and FIG. 3C is an enlarged view of an area A2 in FIG. 3B. In FIG. 3A, the shaft hole 12 of the inner gear 10 is not shown. As shown in FIG. 3B, for each of the inner teeth T21 to T28 of the outer gear 20, a shape of a top land of the tooth, which protrudes in a direction toward the inner gear 10, is set to follow a shape defined by an arc (first arc) Cro having a center Zro and a radius ro. Meanwhile, for each of the inner teeth T21 to T28 of the outer gear 20, a shape of a bottom land of the tooth, which is dented in an opposite direction from the inner gear 10, is not particularly limited to an arc shape, a cycloid curve, etc., and is appropriately set to a curved shape (any continuous curved shape). The outer teeth T11 to T17 of the inner gear 10 each has a shape that is based on a tooth shape formed from a generating curve of the outer gear 20. For each of the outer teeth T11 to T17 of the inner gear 10, a top land of the tooth that protrudes toward the outer gear 20 is set to a curved shape. As shown in FIG. 3C, with respect to the shape formed from the generating curve, both corner sections T11S and T12S from a center of the curved shape of the top land of the tooth are set to follow a shape defined by an arc (second arc) Cri having a center Zri and a radius ri. In this embodiment, an example is described in which the top land of the inner tooth of the outer gear is formed in the arc shape while the bottom land thereof is formed in the curved shape, and in which the outer tooth of the inner gear is formed on the basis of the generating curve of the inner tooth. However, the bottom land of the outer tooth of the inner gear may be formed in the arc shape while the top land thereof may be formed in the curved shape, and the inner tooth of the outer gear may be formed on the basis of the generating curve of the outer tooth. The above curved shape is a shape that curves toward one side. In other words, the curved shape is a shape that is not curved in a zigzag manner. Both end sections of the curved shape, that is, both corner sections are respectively connected to portions that curve toward the side opposite to the side toward which the curved shape curves.

As for FIG. 3A to FIG. 3C, as shown in FIG. 3C, which is an enlarged view of the outer tooth T12 of the inner gear 10 and the inner tooth T22 of the outer gear 20, within a meshing area between the outer tooth T12 and the inner tooth T22, meshing between the outer tooth T12 and the inner tooth T22 starts from a meshing area LA, and then continues to a meshing area LB and a meshing area LC. The meshing area LB is an area where slippage between the outer tooth T12 and the inner tooth T22 hardly occur (the rate of slippage is approximately zero). The meshing area LA is an area immediately before the meshing area LB and where the slippage occurs. The meshing area LC is an area immediately after the meshing area LB, where the corner section of the outer tooth T12 with the arc radius ri presses against the inner tooth T22, and where the slippage occurs. The lengths of the meshing areas LA to LC change according to the shapes of the outer tooth and the inner tooth. In this embodiment, it is possible to change the shapes of the inner tooth and the outer tooth (that is, the lengths of the meshing areas LA to LC) by appropriately changing the radius ro of the arc-shaped top land of the inner tooth (or the radius of the arc-shaped bottom land of the outer tooth). In addition, the length of the meshing area LC can also be changed by appropriately changing the arc radius ri of each of the corner sections of the outer tooth.

The shapes of the outer teeth and the inner teeth can appropriately be changed as described above. By changing the shapes of the outer teeth and the inner teeth, the volume of the closed space 22 (see FIG. 2B) can be changed, and thus the discharging capability of the pump can also be changed. When the internal gear pump is reduced in size, the shapes of the outer teeth and the inner teeth should be changed such that the discharging capability of the pump after the size reduction corresponds to the discharging capability of the pump before the size reduction. A description will be made below on three exemplary shapes of the outer gear 20 and the inner gear 10 by changing the radius ro of the arc Cro of the arc-shaped top land of the inner tooth of the outer gear 20. A description will also be made on differences in lengths of the meshing areas LA to LC for the three shapes. Then, an optical shape that can substantially reduce the slippage will be considered.

[An Example of Changing the Radius Ro of the Arc Cro that Determines the Arc Shape of the Inner Teeth of the Outer Gear 20 (FIG. 4, FIG. 5)]

FIG. 4A to FIG. 4C each shows the shapes of the outer gear 20 and the inner gear 10 in which a dimension of each relevant section thereof is set according to the values indicated in a setting table 60 of FIG. 4D. In FIG. 4A to FIG. 4C, the shaft hole 12 of the inner gear 10 is not shown. An "amount of eccentricity" in the setting table 60 shown in FIG. 4D indicates a distance between the rotational axis Zo of the outer gear 20 and the rotational axis Zi of the inner gear 10. The "number of teeth (z)" indicates the number of the inner teeth of the outer gear 20. The "outer pitch diameter (dp)" indicates the diameter of the outer pitch circle Co, which is the pitch circle of the inner teeth of the outer gear 20. The "inner tooth arc radius (ro)" indicates a radius of the arc Cro, which forms the top lands of the inner teeth of the outer gear 20 in the arc shape. The "outer tooth corner section radius (ri)" indicates a radius of the arc Cri, which forms both of the corner sections from the center of the top land of the outer tooth shown in FIG. 3 in the arc shape. A "ratio ro/(dp/z)" indicates a ratio to determine the height and the shape of the top land of the inner tooth with respect to the entire shape of the outer gear 20. A "ratio ri/(dp/z)" indicates a ratio to determine the shapes of the corner sections from the center of the top land of the outer tooth of the inner gear 10 with respect to the entire shape of the outer gear 20.

The outer gear 20 and the inner gear 10 that are shown as the examples in FIG. 4A have shapes with following setting values indicated in the setting table 60 in FIG. 4D: the amount of eccentricity=1.55 [mm]; the number of teeth (z)=8; the outer pitch diameter (dp)=24.8 [mm]; the inner tooth arc radius (ro)=3.0 [mm]; and the outer tooth corner section radius (ri)=0.30 [mm]. For the shapes shown as the examples in FIG. 4A, the actual value of the ratio of the outer pitch diameter to the inner tooth arc radius is: ro/(dp/z)=0.967 . . . , and the value is presented as 1.0 in the setting table 60 in FIG. 4D. Also, the actual value of the ratio of the outer pitch diameter to the outer tooth corner section radius is: ri/(dp/z)=0.0967 . . . , and the value is presented as 0.10 in the setting table 60 in FIG. 4D.

The outer gear 20 and the inner gear 10 that are shown as the examples in FIG. 4B have shapes with the following setting values indicated in the setting table 60 in FIG. 4D: the amount of eccentricity=1.55 [mm]; the number of teeth (z)=8; the outer pitch diameter (dp)=24.8 [mm]; the inner tooth arc radius (ro)=4.0 [mm]; and the outer tooth corner section radius (ri)=0.42 [mm]. For the shapes shown as the examples in FIG. 4B, the actual value of the ratio of the outer pitch diameter to the inner tooth arc radius is: ro/(dp/z)=1.290 . . . , and the value is presented as 1.3 in the setting table 60 in FIG. 4D. Also, the actual value of the ratio of the outer pitch diameter to the outer tooth corner section radius is: ri/(dp/z)=0.1354 . . . , and the value is presented as 0.13 in the setting table 60 in FIG. 4D.

The outer gear 20 and the inner gear 10 that are shown as the examples in FIG. 4C have shapes with the following setting values indicated in the setting table 60 in FIG. 4D: the amount of eccentricity=1.52 [mm]; the number of teeth (z)=8; the outer pitch diameter (dp)=24.3 [mm]; the inner tooth arc radius (ro)=4.7 [mm]; and the outer tooth corner section radius (ri)=0.38 [mm]. For the shapes shown as the examples in FIG. 4C, the actual value of the ratio of the outer pitch diameter to the inner tooth arc radius is: ro/(dp/z)=1.547 . . . , and the value is presented as 1.6 in the setting table 60 in FIG. 4D. Also, the actual value of the ratio of the outer pitch diameter to the outer tooth corner section radius is: ri/(dp/z)=0.1251 . . . , and the value is presented as 0.12 in the setting table 60 in FIG. 4D.

Figure 5:
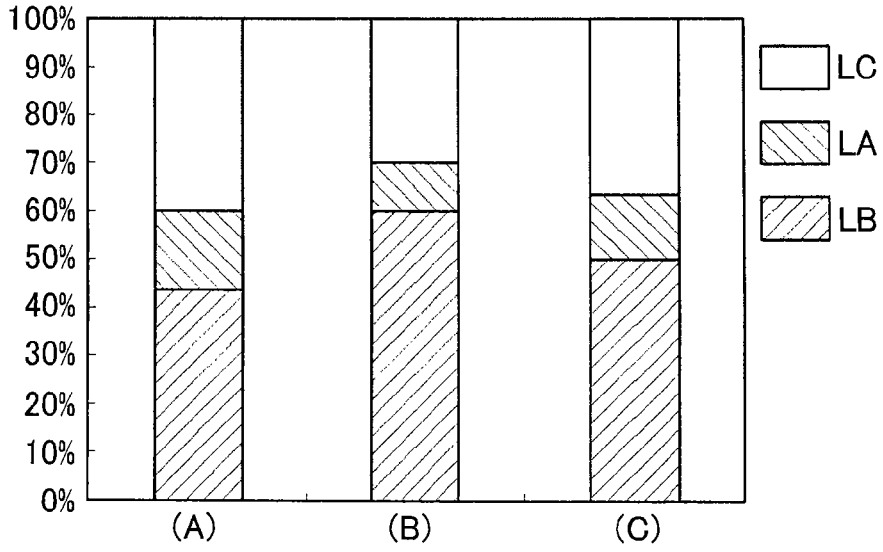
FIG. 5 is a graph for explaining ratio of each meshing area shown in FIG. 3 for each of FIG. 4A to FIG. 4C.

FIG. 5 is a graph in which ratios of the meshing areas LA to LC are calculated in terms of lengths of the meshing areas LA to LC for each of the three shapes in FIG. 4A to FIG. 4C of the outer gear 20 and the inner gear 10. It is considered from this graph that the shape with the highest ratio of the meshing area LB where the rate of slippage is approximately zero is the most efficient shape (with the least resistance). It can be said from the graph in FIG. 5 that the shape shown in FIG. 4B is the most efficient shape. The inventor also confirmed that the discharging capability of the pump for each of the shapes in FIG. 4A to FIG. 4C of the outer gear 20 and the inner gear 10 is equal to or superior to related arts.

Accordingly, it can be considered that the significantly efficient internal gear pump can be created if conditions below are satisfied:

$$1.6 > ro/(dp/z) > 1.0 \quad \text{(Equation 1)}$$

$$ri/(dp/z) \geq 0.13 \quad \text{(Equation 2).}$$

Because ri never becomes larger than ro, Equation 2 can be changed to Equation 3 with more conditions added:

$$ro/(dp/z) > ri/(dp/z) \geq 0.13 \quad \text{(Equation 3).}$$

Therefore, if both of the conditions in Equation 1 and Equation 3 are satisfied, the shapes of the outer gear 20 and the inner gear 10 can be significantly efficient. Here, the shape that has the minimum value (=1.0) to satisfy Equation 1 is the shape shown in FIG. 4A, while the shape that has the maximum value (=1.6) to satisfy Equation 1 is the shape shown in FIG. 4C. Also, the shape that has the minimum value (=0.13) to satisfy Equation 2 is the shape shown in FIG. 4B.

[A Setting Method for Preventing Interference of the Adjacent Inner Teeth in the Outer Gear 20 (FIG. 6, FIG. 7)]

Figure 6:
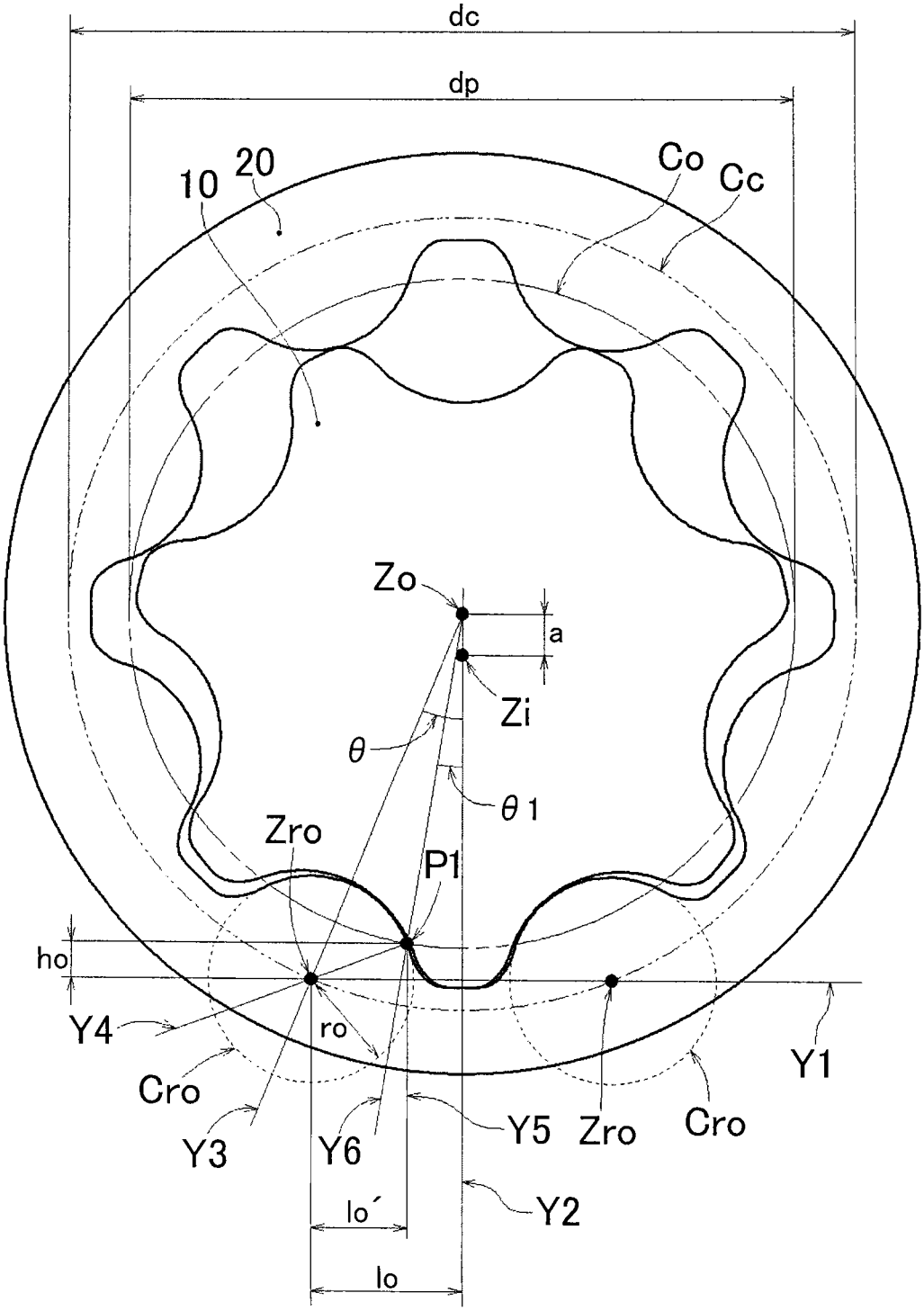
FIG. 6 is a view for explaining a setting method to prevent interference between the adjacent inner teeth.

Next, with reference to FIG. 6 and FIG. 7A to FIG. 7C, a description is made on a setting method for preventing interference of the adjacent inner teeth with each other. As shown in FIG. 6, each of parameters below is set for the adjacent two inner teeth of the outer gear 20:

arc Cro: the arc whose shape follows the arc shape of the top land of the inner tooth of the outer gear 20 (see FIG. 3B);

center Zro: the center of the arc Cro (see FIG. 3B);

outer pitch circle Co: the pitch circle of the inner tooth of the outer gear 20 (see FIG. 3A);

inner tooth center pitch circle Cc: a circle that passes through the center Zro of the arc Cro that follows the arc shape of the inner tooth of the outer gear 20;

ro: the radius of the arc Cro (see FIG. 3B);

dp: the diameter of the outer pitch circle Co (see FIG. 3A);

dc: the diameter of the inner tooth pitch center circle Cc;

a: the amount of eccentricity (the distance between the rotational axis Zo of the outer gear 20 and the rotational axis Zi of the inner gear 10);

z: the number of inner teeth of the outer gear 20;

straight line Y1: a straight line that passes through the center Zro of each of the arcs Cro of the adjacent two inner teeth;

straight line Y2: a straight line that passes through the rotational axis Zo of the outer gear 20 and crosses the straight line Y1 at right angles;

straight line Y3: a straight line that passes through the rotational axis Zo of the outer gear 20 and the center Zro of one of the arcs Cro;

intersecting point P1: an intersecting point that is between the one arc Cro and the outer pitch circle Co and is in proximity to the other arc Cro;

θ: an angle between the straight line Y2 and the straight line Y3;

straight line Y4: a straight line that passes through the intersecting point P1 and the center Zro of the arc Cro having the intersecting point P1;

straight line Y5: a straight line that passes through the intersecting point P1 and is parallel to the straight line Y2;

straight line Y6: a straight line that passes through the rotational axis Zo of the outer gear 20 and the intersecting point P1;

θ1: an angle between the straight line Y2 and the straight line Y6 and smaller than the angle θ;

ho: a distance between the intersecting point P1 and the straight line Y1;

lo: a distance between the center Zro and the straight line Y2;

lo': a distance between the center Zro and the straight line Y5.

If the above parameters are set, following Equation 4 to Equation 8 are formulated:

$$\theta=360°/2z \quad \text{(Equation 4);}$$

$$dp=2az \quad \text{(Equation 5);}$$

$$ho=(dc/2)*\cos\theta-(dp/2)*\cos\theta 1 \quad \text{(Equation 6);}$$

$$lo=(dc/2)*\sin\theta \quad \text{(Equation 7);}$$

$$lo''=\sqrt{(ro2-ho2)} \quad \text{(Equation 8).}$$

Then, in the internal gear pump 1 of the present invention, the position of the center Zro of the arc Cro that follows that arc shape of the inner tooth of the outer gear 20 is set within a range that satisfies following Equation 9:

$$lo'<lo \quad \text{(Equation 9).}$$

Figure 7A:
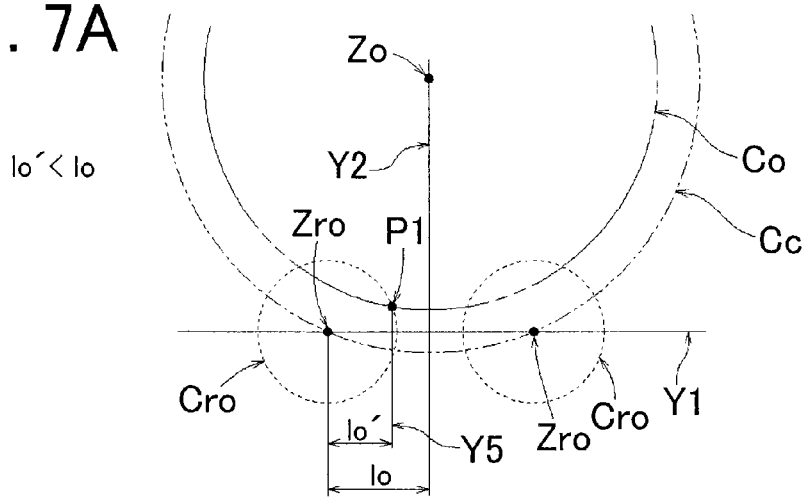
FIG. 7A is a view for explaining a state in which the adjacent inner teeth are arranged in locations where the adjacent inner teeth do not interfere with each other.
Figure 7B:
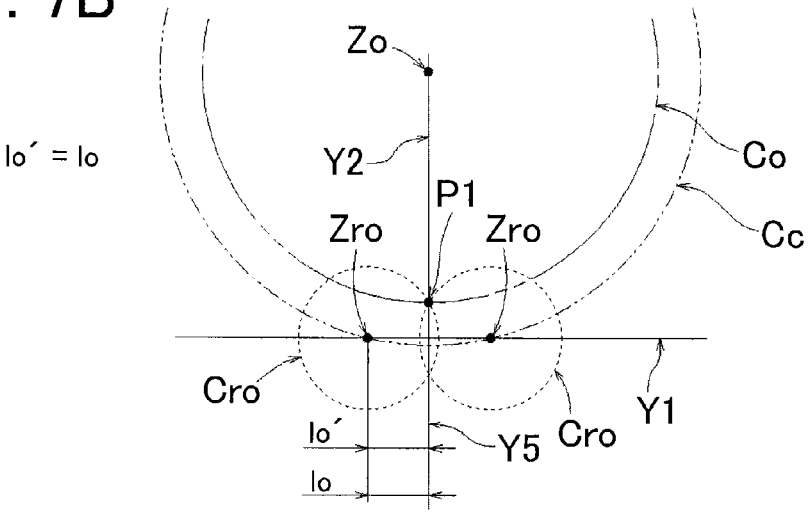
FIG. 7B and FIG. 7C are views for explaining a state in which the adjacent inner teeth are arranged in locations where the adjacent inner teeth interfere with each other.
Figure 7C:
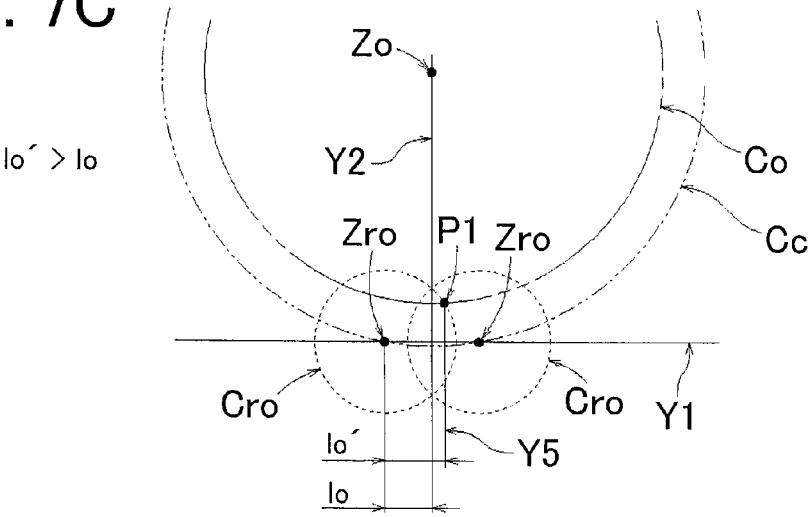

FIG. 7A is a view that shows the outer pitch circle Co, the inner tooth center pitch circle Cc, the arc Cro, and the center Zro in a state where the center Zro is set within the range that satisfies the Equation 9 (lo'<lo). In this setting, in the adjacent two inner teeth, the intersecting point P1, which is the intersecting point between the one arc Cro (the arc that follows the arc shape of the inner tooth) and the outer pitch circle Co and is in proximity to the other arc Cro, is located outside of the other arc Cro. In this state, because the adjacent inner teeth are set not to interfere with each other, the inner teeth are arranged in preferred positions. FIG. 7B is a view that shows the outer pitch circle Co, the inner tooth center pitch circle Cc, the arc Cro, and the center Zro in a state where the center Zro is set in a range that does not satisfies the Equation 9 (lo'=lo). In this setting, in the adjacent two inner teeth, the intersecting point P1, which is the intersecting point between the one arc Cro and the outer pitch circle Co and is in proximity to the other arc Cro, is located on the circumference of the other arc Cro. In this state, because the adjacent inner teeth interfere with each other, the inner teeth are arranged in unfavorable positions. FIG. 7C is a view that shows the outer pitch circle Co, the inner tooth center pitch circle Cc, the arc Cro, and the center Zro in a state where the center Zro is set in the range that does not satisfies the Equation 9 (lo'>lo). In this setting, in the adjacent two inner teeth, the intersecting point P1, which is the intersecting point between the one arc Cro and the outer pitch circle Co and is in proximity to the other arc Cro, is located inside of the other arc Cro. In this state, because the adjacent inner teeth interfere with each other, the inner teeth are arranged in the unfavorable positions.

The internal gear pump 1 of the present invention is not limited to the appearances, configurations, structures, etc. that are described in the embodiment, and various modifications, additions, and substitutions can be made without departing from the scope of the present invention. In the internal gear pump 1 of the present invention, the number of teeth of the outer gear and that of the inner gear are not limited to the numbers described in the embodiment, and various numbers of teeth can be adopted for the outer gear and the inner gear. The internal gear pump 1 of the present invention can be used not only as various types of oil pumps used for automobiles but also as various machinery pumps that perform suction and discharge of various types of fluids.

What is claimed is:

1. An internal gear pump comprising:

an inner gear that has plural outer teeth on an outer peripheral surface of the inner gear; and an outer gear that is formed with a housing space that is capable of housing the inner gear and that includes plural inner teeth meshing with the outer teeth on an inner peripheral surface that forms the housing space, one of the inner teeth and the outer teeth having a shape based on a tooth form that is respectively formed by a generating curve of the other of the inner teeth and the outer teeth, a section of each of the inner teeth that protrudes in a direction toward the inner gear having a first arc shape, a section of each of the outer teeth that protrudes in a direction toward the outer gear having a curved shape, each of both end sections of the curved shape having a second arc shape, if a radius of the first arc shape is set as ro, a radius of the second arc shape is set as ri, a diameter of a pitch circle of the inner teeth is set as dp, and the number of the inner teeth is set as z, the inner gear and the outer gear each having a shape that satisfies a relationship established by following equations: $1.6>ro/(dp/z)>1.0$; and $ro/(dp/z)>ri/(dp/z)\geq 0.13$, and each of the inner teeth being provided so that an intersecting point that is between one of arcs that follow the first arc shapes of the adjacent inner teeth and the pitch circle of the inner teeth and that is in proximity to the other arc is located outside of the other arc.

* * * * *

UNITED STATES PATENT AND TRADEMARK OFFICE

CERTIFICATE OF CORRECTION

PATENT NO. : 8,851,869 B2
APPLICATION NO. : 13/705596
DATED : October 7, 2014
INVENTOR(S) : Yoshihiro Oono et al.

It is certified that error appears in the above-identified patent and that said Letters Patent is hereby corrected as shown below:

On the Title page, Item 71, change from "JTEKT Corporation, Osaka, JP"

to -- JTEKT Corporation, Osaka, JP, and TOYOOKI KOGYO, Co., LTD., Aichi, JP --.

Signed and Sealed this
Tenth Day of February, 2015

Michelle K. Lee

Michelle K. Lee
*Deputy Director of the United States Patent and Trademark Office*